US008340305B2

(12) United States Patent
Delattre

(10) Patent No.: US 8,340,305 B2
(45) Date of Patent: Dec. 25, 2012

(54) AUDIO ENCODING METHOD AND DEVICE

(75) Inventor: Alexandre Delattre, Viroflay (FR)

(73) Assignee: Mobiclip, Paris (FR)

( * ) Notice: Subject to any disclaimer, the term of this patent is extended or adjusted under 35 U.S.C. 154(b) by 549 days.

(21) Appl. No.: 12/521,076

(22) PCT Filed: Dec. 28, 2007

(86) PCT No.: PCT/EP2007/011442

§ 371 (c)(1),
(2), (4) Date: Oct. 27, 2009

(87) PCT Pub. No.: WO2008/080609

PCT Pub. Date: Jul. 10, 2008

(65) Prior Publication Data

US 2010/0046760 A1 Feb. 25, 2010

(30) Foreign Application Priority Data

Dec. 28, 2006 (FR) ..... 06 11481
Nov. 16, 2007 (FR) ..... 07 08067

(51) Int. Cl.
*H04R 5/00* (2006.01)
*G10L 19/00* (2006.01)

(52) U.S. Cl. ..... 381/22; 381/17; 381/18; 381/19; 381/20; 381/21; 381/23; 381/1; 381/2; 381/119; 700/94; 704/501; 704/503; 704/504; 704/220; 704/200

(58) Field of Classification Search ..... 381/17–23, 381/1, 2, 119; 700/94; 704/501, 503, 504, 704/220, 200.1, 270
See application file for complete search history.

(56) References Cited

U.S. PATENT DOCUMENTS

| | | | | |
|---|---|---|---|---|
| 4,757,517 | A | 7/1988 | Yatsuzuka | |
| 5,974,380 | A * | 10/1999 | Smyth et al. | 704/229 |
| 6,226,616 | B1 * | 5/2001 | You et al. | 704/500 |
| 6,674,862 | B1 * | 1/2004 | Magilen | 381/60 |
| 7,573,912 | B2 * | 8/2009 | Lindblom | 370/487 |
| 7,725,324 | B2 * | 5/2010 | Bruhn et al. | 704/500 |

(Continued)

FOREIGN PATENT DOCUMENTS

WO WO 02/41301 5/2002

(Continued)

OTHER PUBLICATIONS

Goodwin et al, Frequency-Domain Algorithms for Audio Signal Enhancement Based on Transient Modification, AES, Jun. 2006.*

(Continued)

*Primary Examiner* — Davetta W Goins
*Assistant Examiner* — Kuassi Ganmavo
(74) *Attorney, Agent, or Firm* — Nixon & Vanderhye P.C.

(57) ABSTRACT

Audio encoding method and device comprising the transmission, in addition to the data representing a frequency-limited signal, of information relating to a temporal filter that is to be applied to the entire enhanced signal, both in its transmitted low-frequency part and in its reconstituted high-frequency part. The application of this filter for reshaping the reconstituted high-frequency part and the correction of compression artefacts present in the transmitted low-frequency part. In this way, the application of the temporal filter, simple and inexpensive, to all or part of the reconstituted signal, makes it possible to obtain a signal of good perceived quality.

18 Claims, 3 Drawing Sheets

U.S. PATENT DOCUMENTS

| | | | | |
|---|---|---|---|---|
| 7,840,401 | B2 * | 11/2010 | Pang et al. | 704/201 |
| 7,945,447 | B2 * | 5/2011 | Yoshida et al. | 704/500 |
| 7,979,271 | B2 * | 7/2011 | Bessette | 704/219 |
| 8,019,087 | B2 * | 9/2011 | Goto et al. | 381/17 |
| 2003/0158726 | A1 | 8/2003 | Philippe et al. | |
| 2005/0246164 | A1 * | 11/2005 | Ojala et al. | 704/205 |
| 2006/0235678 | A1 | 10/2006 | Kim et al. | |
| 2007/0236858 | A1 * | 10/2007 | Disch et al. | 361/272 |

FOREIGN PATENT DOCUMENTS

| | | |
|---|---|---|
| WO | WO 2004/093494 | 10/2004 |

OTHER PUBLICATIONS

Avendano et al; Temporal Processing of Speech in a Time-Feature Space, Thesis, 1993.*

PCT/EP2007/011442; Preliminary Examination Report on Patentability in English.

International Search Report for PCT/EP2007/011442, mailed Mar. 7, 2008.

Foreign-language Written Opinion of the International Searching Authority for PCT/EP2007/011442, mailed Mar. 7, 2008.

* cited by examiner

AUDIO ENCODING METHOD AND DEVICE

This application is the U.S. national phase of International Application No. PCT/EP2007/011442, filed 28 Dec. 2007, which designated the U.S. and claims priority to France Application Nos. 06/11481 filed 28 Dec. 2006 and 07/08067, filed 16 Nov. 2007, the entire contents of each of which are hereby incorporated by reference.

TECHNICAL FIELD OF THE INVENTION

The present invention concerns an audio encoding method and device. It applies in particular to the encoding with enhancement of all or part of the audio spectrum, in particular with a view to transmission thereof over a computer network, for example the Internet, or storage thereof on a digital information medium. This method and device can be integrated in any system for compressing and then decompressing an audio signal on all hardware platforms.

BACKGROUND OF THE INVENTION

In audio compressions, the rate is often reduced by limiting the bandwidth of the audio signal. Generally, only the low frequencies are kept since the human ear has better spectral resolution and sensitivity at low frequency than at high frequency. Typically, only the low frequencies of the signal are kept, and thus the rate of the data to be transferred is all the lower. As the harmonics contained in the low frequencies are also present in the high frequencies, some methods of the prior art attempt, from the signal limited to low frequencies, to extract harmonics that make it possible to recreate the high frequencies artificially. These methods are generally based on a spectral enhancement consisting of recreating a high-frequency spectrum by transposition of the low-frequency spectrum, this high-frequency spectrum being reshaped spectrally. The resulting signal is therefore composed, for the low-frequency part, of the low-frequency signal received and, for the high-frequency part, the reshaped enhancement.

It turns out that the compression and method used for compressing and limiting the bandwidth of the initial frequency generate artefacts impairing the quality of the signal. Moreover, the reconstitution of a quality signal in reception must make it possible to obtain the best possible perceived quality while requiring only a small transmitted data bandwidth and simple and rapid processing on reception.

SUMMARY OF THE INVENTION

This problem is advantageously resolved by the transmission, in addition to the data representing the frequency-limited signal, of information relating to a temporal filter that is to be applied to the whole of the enhanced signal, both in its transmitted low-frequency part and in its reconstituted high-frequency part, the application of this filter allowing the reshaping of the reconstituted high-frequency part and the correction of compression artefacts present in the transmitted low-frequency part. In this way, the application of the temporal filter, which is simple and inexpensive, to the whole of the reconstituted signal makes it possible to obtain a good-quality perceived signal.

The invention concerns a method of encoding all or part of a multi-channel audio stream comprising a step of obtaining a complex signal obtained by the composition of signals corresponding to each channel of the multi-channel audio stream; a step of obtaining a frequency-limited complex signal, the reduction of the frequency of the original complex signal being obtained by suppression of the high frequencies, and a step of generating one temporal filter per channel making it possible to find a signal spectrally close to the original signal of the corresponding channel when it is applied to the signal obtained by broadening of the spectrum of the limited composite signal.

According to a particular embodiment of the invention, for a given portion of the original signal, for a given channel, the filter corresponding to this channel is obtained by member to member division of a function of the coefficients of a Fourier transform applied to the portion of the original signal and to the corresponding portion of the signal obtained by broadening of the spectrum of the limited signal.

According to a particular embodiment of the invention, Fourier transforms of different sizes are used for obtaining a plurality of filters corresponding to each size used, the generated filter corresponding to a choice from the plurality of filters obtained by comparison of the original signal, and the signal obtained by application of the filter to the signal obtained by broadening of the spectrum of the limited signal.

According to a particular embodiment of the invention, the choice of the temporal filter can be made in a collection of predetermined temporal filters.

According to a particular embodiment of the invention, the frequency-limited composite signal being encoded with a view to transmission thereof the filter is generated using the signal obtained by decoding and broadening of the spectrum of the encoded limited composite signal and the original signal.

According to a particular embodiment of the invention, the method also comprises a step of defining one of the channels of the multi-channel audio stream as the reference channel; a step of temporal correlation of each of the other channels on the said reference channel defining for each channel an offset value and the step of composing the signals of each channel is carried out with the signal of the reference channel and the signals correlated temporally for the other channels.

According to a particular embodiment of the invention, for each channel other than the reference channel, the offset value defined by the temporal correlation of the channel is associated with the generated filter.

According to a particular embodiment of the invention, the method also comprises a step of defining one of the channels of the multi-channel audio stream as the reference channel; a step of equalising each of the other channels on the said reference channel defining for each channel an amplification value, and the step of composing the signals of each channel is carried out with the signal of the reference channel and the equalised signals for the other channels.

According to a particular embodiment of the invention, for each channel other than the reference channel, the amplification value defined by the temporal correlation of the channel is associated with the generated filter.

The invention also concerns a method of decoding all or part of a multi-channel audio stream, comprising at least a step of receiving a transmitted signal; a step of receiving a temporal filter relating to the signal received for each channel of the multi-channel audio stream; a step of obtaining a signal decoded by decoding the received signal; a step of obtaining a signal extended by broadening of the spectrum of the decoded signal and a step of obtaining a signal reconstructed by convolution of the extended signal with the temporal filter received for each channel of the multi-channel audio stream.

According to a particular embodiment of the invention, a filter reduced in size from the filter generated is used in place of this generated filter in the step of obtaining a reconstructed signal for each channel.

According to a particular embodiment of the invention, the choice of using a filter of reduced size in place of the filter generated for each channel is made according to the capacities of the decoder.

According to a particular embodiment of the invention, one of the channels of the multi-channel stream being defined as the reference channel, an offset value being associated with each filter received for the channels other than the reference channel, the method also comprises a step of offsetting the signal corresponding to each channel other than the reference channel making it possible to generate a temporal phase difference similar to the temporal phase difference between each channel and the reference channel in the original multi-channel audio stream.

According to a particular embodiment of the invention, the method also comprises a step of smoothing the offset values at the boundaries between the working windows so as to avoid an abrupt change in the offset value for each channel other than the reference channel.

According to a particular embodiment of the invention, one of the channels of the multi-channel stream being defined as the reference channel, an amplification value being associated with each filter received for the channels other than the reference channel, the method also comprises a step of amplifying the signal corresponding to each channel other than the reference channel and making it possible to generate a difference in gain similar to the difference in gain between each channel and the reference channel in the original multi-channel audio stream.

The invention also concerns a device for encoding a multi-channel audio stream comprising at least means of obtaining a composite signal obtained by composition of the signals corresponding to each channel of the multi-channel audio stream; means of obtaining a frequency-limited composite signal, the reduction of the spectrum of the original composite signal being obtained by suppression of the high frequencies and means of generating one temporal filter per channel, making it possible to find a signal spectrally close to the original signal of the corresponding channel when it is applied to the signal obtained by broadening the spectrum of the limited signal.

The invention also concerns a device for decoding a multi-channel audio stream comprising at least the following means: means of receiving a transmitted signal; means of receiving a temporal filter relating to the signal received for each channel of the multi-channel audio stream; means of obtaining a decoded signal by decoding the signal received; means of obtaining a signal extended by broadening of the spectrum of the decoded signal and means of obtaining a signal reconstructed by convolution of the extended signal with the temporal filter received for each channel of the multi-channel audio stream.

BRIEF DESCRIPTION OF THE DRAWINGS

The features of the invention mentioned above, as well as others, will emerge more clearly from a reading of the following description of an example embodiment, the said description being given in relation to the accompanying drawings, among which.

DETAILED DESCRIPTION OF THE INVENTION

Figure 1:
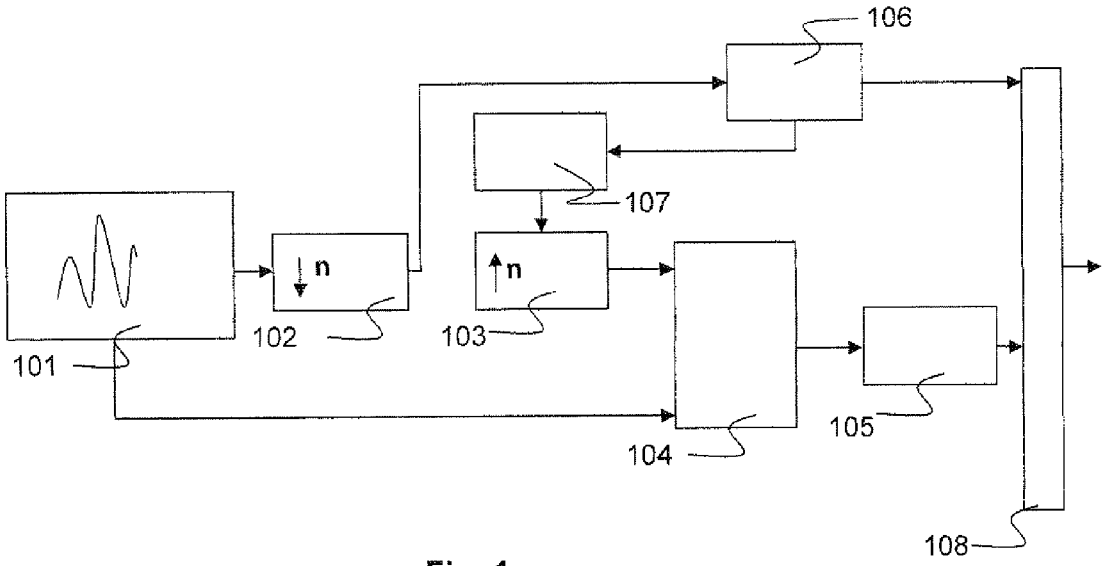
FIG. 1 shows the general architecture of the method of encoding an example embodiment of the invention.

FIG. 1 shows the encoding method in general terms. The signal 101 is the source signal that is to be encoded, and this signal is then the original signal not limited in terms of frequency. Step 102 shows a step of frequency limitation of the signal 101. This frequency limitation can for example be implemented by a subsampling of the signal 101 previously filtered by a low-pass filter. A subsampling consists of keeping only one sample on a set of samples and suppressing the other samples from the signal. A subsampling by a factor of "n" where one sample out of n is kept makes it possible to obtain a signal where the width of the spectrum will be divided by n. n is here a natural integer. It is also possible to effect a subsampling by a rational ratio q/p; supersampling is carried out by a factor p and then subsampling by a factor q. It is preferable to commence with supersampling in order not to lose spectral content. For a change in frequency by a non-rational ratio, it is possible to seek the closest rational fraction and to proceed as above. Other methods of limiting the band of the input signal 101 can also be used as basic filtering methods. The resulting signal, which will be termed the frequency-limited signal, is then encoded during step 106. Any audio encoding or compression means can be used here such as for example an encoding according to the PCM, ADPCM or other standards. This frequency-limited signal will be supplied to the multiplexer 108 with a view to transmission thereof to the decoder.

The frequency-limited signal encoded at the output from the compression module 106 is also supplied as an input to a decoding module 107. This module performs the reverse operation to the encoding module 106 and makes it possible to construct a version of the frequency-limited signal identical to the version to which the decoder will have access when it also performs this operation of decoding the encoded limited signal that it will receive. The limited signal thus decoded is then restored in the original spectral range by a frequency-enhancement module 103. This frequency enhancement can for example consist of a simple supersampling of the input signal by the insertion of samples of nil value between the samples of the input signal. Any other method of enhancing the spectrum of the signal can also be used. This extended frequency signal, issuing from the frequency enhancement module 103, is then supplied to a filter generation module 104. This filter generation module 104 also receives the original signal 101 and calculates a temporal filter making it possible, when it is applied to the extended signal issuing from the frequency enhancement module 103, to shape it so as to come close to the original signal. The filter thus calculated is then supplied to the multiplexer 108 after an optional compression step 105.

In this way it is possible to transport a frequency-limited and compressed version of the signal to be transmitted and the coefficients of a temporal filter. This temporal filter making it possible, once applied to the decompressed and frequency-extended signal, to reshape the latter in order to find an extended signal close to the original signal. The calculation of the filter being made on the original signal and on the signal as will be obtained by the decoder following the decompression and frequency-enhancement makes it possible to correct any defects introduced by these two processing phases. Firstly, the filter being applied to the reconstructed signal in its entire frequency range makes it possible to correct certain compression artefacts on the low-frequency part transmitted. Moreover, it also reshapes the high-frequency part, not transmitted, reconstructed by frequency enhancement.

Figure 2:
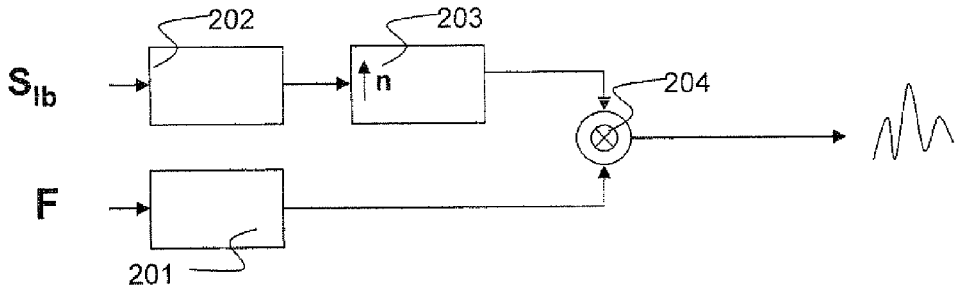
FIG. 2 shows the general architecture of the decoding method of the example embodiment of the invention.

FIG. 2 shows in general terms the corresponding decoding method. The decoder therefore receives the signal issuing from the multiplexer 18 of the coder. It demultiplexes it in order to obtain the encoded frequency-limited signal, called S1*b*, and the coefficients of the filter F, contained in the transmitted signal. The signal S1*b* is then decoded by a decoding and decompression module 202 functionally equivalent to the module 107 in FIG. 1. Once decoded, the signal is extended in frequency by the module 203 equivalent functionally to the module 103 of FIG. 1. A decoded and frequency-extended version of the signal is therefore obtained. In addition, the coefficients of the filter F are decoded if they had been encoded or compressed by a decompression module 201, and the filter obtained is applied to the extended temporal signal in a module for shaping the signal 204. A signal is then obtained as an output close to the original signal. This processing is simple to implement because of the temporal nature of the filter to be applied to the signal for re-shaping.

The filter transmitted, and therefore applied during the reconstruction of the signal, is transmitted periodically and changes over time. This filter is therefore adapted to a portion of the signal to which it applies. It is thus possible to calculate, for each portion of the signal, a temporal filter particularly adapted according to the dynamic spectral characteristics of this signal portion. In particular, it is possible to have several types of temporal filter generator and to select, for each signal portion, the filter giving the best result for this portion. This is possible since the filter generation module possesses firstly the original signal and secondly the extended signal as will be reconstructed by the decoder and it is therefore in a position, where it is generated by several different filters, to compare the signal obtained by application of each filter to the extended signal portion and the original signal to which it is sought to approach as close as possible. This filter generation method is therefore not limited to choosing a given type of filter for the whole of the signal but makes it possible to change the type of filter according to the characteristics of each signal portion.

Figure 3:
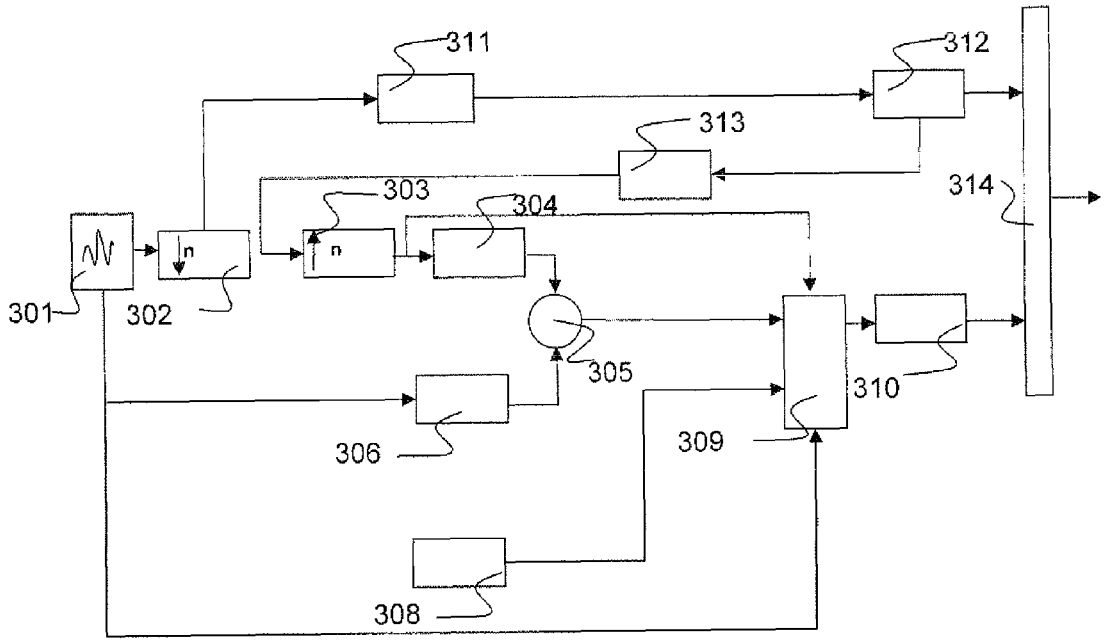
FIG. 3 shows the architecture of an embodiment of the encoder.

A particular embodiment of the invention will now be described in detail with the help of FIGS. 3 and 4. In this embodiment, it is sought, from a signal sampled at a given frequency 301, for example 32 kHz, to obtain the signal limited to its low frequencies, called S1*b*. It is also sought to determine a filter F for shaping the signal obtained by extending in frequency the signal S1*b*. The original signal 301 is filtered by a low-pass filter and subsampled by a factor n by the subsampling module 302. From the original signal only one sample out of n is kept, where n is a natural integer. In practice, n does not generally exceed 4. The signal then loses in terms of spectral resolution and, for example, for n=2, a signal sampled at 16 kHz is obtained. This signal is then encoded, for example by a method of the PCM ("Pulse Code Modulation") type, by the module 311, which will then be compressed, for example by an ADPCM (the module 302). In this way the subsampled signal is obtained containing the low frequencies of the original signal 301. This signal is sent to the multiplexer 314 in order to be sent to the decoder.

In parallel, this signal is transmitted to a decoding module 313. In this way, in the encoder, the signal that the decoder will obtain from the signal that will be sent to it is simulated. This signal, which will be used for generating the filter F, will therefore make it possible to take account of the artefacts resulting from these coding and decoding, compression and decompression, phases. This signal is then extended in frequency by insertion of n−1 zeros between each sample of the temporal signal in the module 303. In this way a signal with the same spectral range as the original signal is reconstructed. According to the Nyquist theorem, an $n^{th}$ order spectral aliasing is obtained. For example, for n=2, the signal is subsampled by a 2nd order on encoding and supersampled by a 2nd order on decoding. The spectrum is "mirror" duplicated by axial symmetry in the frequency domain. In the module 304, a Fourier transform is performed on the frequency-extended temporal frequency issuing from the module 303. In fact, a sliding fast Fourier transform is effected on working windows of given variable size. These sizes are typically 128, 256, 512 samples but may be of any size even if use will preferentially be made of powers of two to simplify the calculations. Next the moduli of these transforms applied to these windows are calculated. The same Fourier transform calculation is performed on the original signal in the module 306.

A member to member division 305 is then performed between the moduli of the coefficients of the Fourier transform obtained by steps 304 and 306 in order to generate, by inverse Fourier transforms, temporal filters of sizes proportional to those of the windows used, and therefore 128, 256 or 512. The greater the size of the window chosen, the more coefficients the filter will include and the more precise it will be, but the more expensive its application will be in terms of calculation on decoding. This step therefore generates several filters of different sizes from which it will be necessary to choose the filter finally used. It will be seen that this choice step is performed by the module 309. As the coefficients of the ratio between the windows are real, and symmetrical in the space of the frequencies, the equivalent filter F is then, in the temporal domain, real and symmetrical. This property of symmetry can be used to transmit only half of the coefficients, the other being deduced by symmetry. Obtaining a symmetrical real filter also makes it possible to reduce the number of operations necessary during convolution of the extended received signal by the filter in the decoder. Other embodiments make it possible to obtain non-symmetrical real filters. For example, if the temporal signal in a working window is limited in frequency, it is possible advantageously to determine iteratively the parameters of a Chebyshev low-pass filter with infinite impulse response from spectra issuing from steps 304 and 306 and the cutoff frequency of the window.

In this way the filter is obtained, in the temporal space, supplied by the input of the choice module 309.

Optionally, a module 308 will offer other types of filter. For example, it may offer linear, cubic or other filters. These filters are known for allowing supersampling. To calculate the values of the samples added with an initial value at zero between the samples of the frequency-limited signal, it is possible to duplicate the value of the known sample, to take an average between the samples, which amounts to making a linear interpolation between the known values of the samples. All these types of filter are independent of the value of the signal and make it possible to re-shape the supersampled signal. The module 308 therefore contains an arbitrary number of such filters that can be used.

The choice module 309 will therefore have a collection of filters at the input. It will have the filters generated by the module 307 and corresponding to the filters generated for various sizes of window by division of the moduli of the Fourier transforms applied to the original signal and to the reconstructed signal. It will also have as an input the original signal 301 and the reconstructed signal issuing from the module 303. In this way, the module 309 can compare the application of the various filters to the reconstructed signal issuing from the module 303 with the original signal in order to choose the filter giving, on the signal portion in question, the best output signal, that is to say closest spectrally to the original signal. For example, it is possible to make the ratio between the spectrum obtained by application of the filter to the signal issuing from the module 303 and the spectrum of the same portion of the original signal. The filter generating the minimum of a function of the distortion is then chosen. This signal portion, called the working window, will have to be larger than the largest window that was used for calculating the filters; it will be possible to use typically a working window size of 512 samples. The size of this working window can also vary according to the signal. This is because a large size of working window can be used for the encoding of a substantially stationary part of the signal while a shorter window will be more suitable for a more dynamic signal portion in order to better take into account fast variations. It is this part that makes it possible to select, for each portion of the signal, the most relevant filter allowing the best reconstruction of the signal by the decoder and to get close to the original signal.

Once this filter is chosen, the module 310 will quantize the spectral coefficients of the filter that will be encoded, for example using a Huffman table for optimising the data to be transmitted. The multiplexer 314 will therefore multiplex, with each portion of the signal, the most relevant filter for the decoding of this signal portion. This filter, being chosen either in the collection of filters of different sizes generated by analysis of this signal portion, or in the collection, also comprises a series of given filters, typically linear, allowing the reconstruction, which can be chosen if they prove to be more advantageous for the reconstruction of the signal portion by the decoder. When the filter generated is one of the given filters, it is possible to transmit only an identifier identifying this filter among the collection of given filters, typically linear, allowing reconstruction, which can be chosen if they prove to be more advantageous for the reconstruction of the signal portion by the decoder. When the filter generated is one of the given filters, it is possible to transmit only an identifier identifying this filter among the collection of given filters supplied by the module 308, as well as any parameters of the filter. This is because, the coefficients of these given filters not being calculated according to the signal portion to which it is wished to apply them, it is unnecessary to transport these coefficients, which can be known to the decoder. Thus the bandwidth for transporting information relating to the filter is reduced in this case to a simple identifier of the filter.

Figure 4:
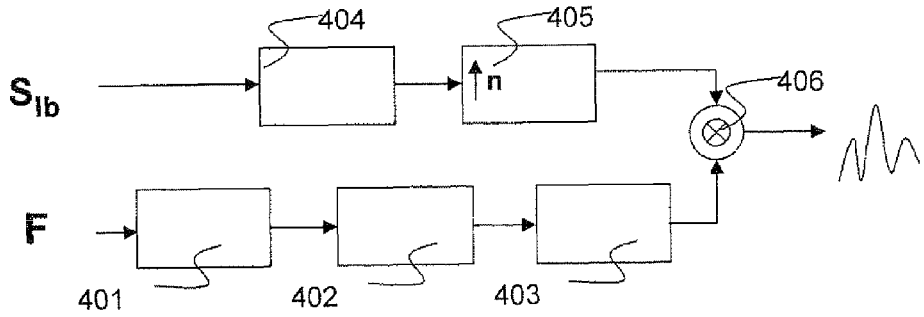
FIG. 4 shows the architecture of an embodiment of the decoder.

FIG. 4 shows the corresponding decoding in the particular embodiment described. The signal is received by the decoder, which demultiplexes the signal. The audio signal S1*b* is then decoded by the module 404 and then supersampled by a factor of n by the insertion of n−1 samples at zero between the samples received by the module 405. In parallel, the spectral coefficients of the filter F are dequantized and decoded in accordance with the Huffman tables by the module 401. Advantageously, the size of the filter can be adapted by the module 402 of the decoder to its calculation or memory capacities or any possible hardware limitation. A decoder having few resources will be able to use a subsampled filter, which will enable it to reduce the operations when the fitter is applied. The subsampled filter can also be generated by the encoder according to the resources of the transmission channel or the resources of the decoder, provided of course that the latter information is held by the encoder. In addition, the spectrum of the filter can be reduced on decoding in order to effect a Lesser supersampling (n−1, n−2 etc) according to the sound rendition hardware capacities of the decoder such as the sound output power or capacities. The module 403 then effects an inverse Fourier transform on the spectral coefficients of the filter in order to obtain the real filter in the temporal domain. In the example embodiment, the filter is more symmetrical, which makes it possible to reduce the data transported for the transmission of the filter. The module 406 effects the convolution of the supersampled signal issuing from the module 405 with the filter thus constituted in order to obtain the resulting signal. This convolution is particularly economical in terms of calculation because the supersampling takes place by the insertion of nil values. Moreover, the fact that the filter is real, and even symmetrical in the preferred embodiment, also makes it possible to reduce the number of operations necessary for this convolution.

The filter being applied to the whole of the frequency-extended signal, the invention offers the advantage of effecting a reshaping not only of the high part of the spectrum reconstituted from the transmitted low part but the whole of the signal thus reconstituted. In this way, it makes it possible to model the part of the spectrum not transmitted but also to correct artefacts due to the various operations of compressing, decompressing encoding and decoding the low-frequency part transmitted.

A secondary advantage of the invention is the possibility of dynamically adapting the filters used according to the nature of each signal portion by virtue of the module allowing choice of the best filter, in terms of quality of sound rendition and "machine time" used, among several for each portion of the signal.

The encoding method thus described for a single-channel signal can be adapted for a multi-channel signal. The first obvious adaptation consists of the application of the single-channel solution to each audio channel independently. This solution nevertheless proves expensive in that it does not take advantage of the strong correlation between the various channels of a multi-channel audio stream. The solution proposed consists of composing a single channel from the different channels of the stream. A processing similar to that described above in the case of a single-channel signal is then effected on this composite stream. Unlike the single-channel method, in the case of the multi-channel, one filter is determined for each channel so as to reproduce the channel in question when it is applied to the composite stream. In this way a multi-channel audio stream is transmitted, transmitting only one composite stream and as many filters as there are channels to be transmitted. The method will now be described more precisely with the help of FIGS. 5 and 6 in the case of stereophony. The stereophonic implementation extends in a natural manner to a composite stream of more than two channels such as a 5.1 stream for home cinema for example.

Figure 5:
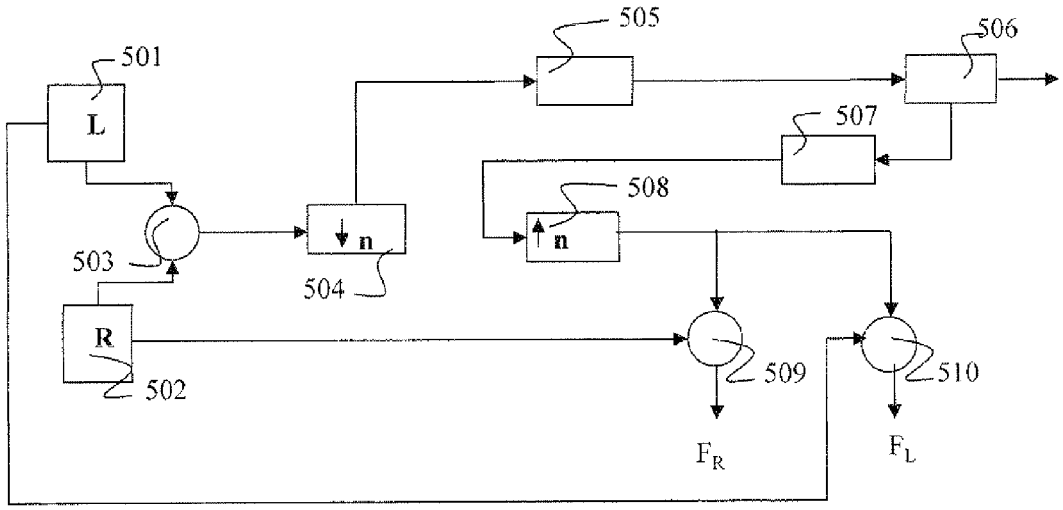
FIG. 5 shows the architecture of a stereophonic embodiment of the encoder.

FIG. 5 shows the architecture of a stereophonic encoder according to an embodiment of the invention. The audio stream to be encoded is composed of a left channel "L" referenced 501 and a right channel "R" referenced 502. A composition module 503 composes these two signals in order to generate a composite signal. This composition may for example be an average of the two channels, and the composite signal is then equal to L+R/2. This composite signal then undergoes the same processing as the single-channel signal described above. It undergoes a subsampling by a factor of n by the subsampling module 504. The subsampled signal is then coded by a coder 505 in order to be encoded by an encoder 506. These modules are the same as the modules already described 311 and 312 in FIG. 3. The subsampled and encoded composite signal is transmitted to the destination of the stream. It is also decoded by a decoding module 507 corresponding to the module 313 in FIG. 3. Next it is supersampled by the supersampling module 508 corresponding to the module 303. The signal is then processed by two filter generation modules 509 and 510. Each of these modules corresponds to the modules 304, 305, 306, 308, 309 and 310 in FIG. 3. The first, 509, generates a filter $F_R$ which makes it possible, when it is applied to the composite stream issuing from the module 508, to generate a signal close to the right-hand channel R. This module takes as an input the composite signal issuing from the module 508 and the original signal from the right-hand channel R 502. The second, 510, generates a filter $F_L$, that makes it possible, when it is applied to the composite stream issuing from the module 508, to generate a signal close to the left-hand channel L. This module takes as an input the composite signal issuing from the module 508 and the original signal from the left-hand channel L 501. These filters, or an identifier for these filters, are then multiplexed with the subsampled stream and encoded issuing from the encoding module 506 in order to be sent to the receiver.

Generally the various channels of a multi-channel signal have a high correlation but exhibit a temporal phase difference. A slight temporal shift occurs between the signals of the different channels. Because of this, when the two, or more, channels are averaged in order to generate the composite signal, this offset tends to generate noise. Advantageously therefore one of the channels is chosen in order to serve as a reference, for example the left-hand channel "L", and the other channels are reset to this reference channel prior to the composition of the composite signal. This resetting is carried out by temporal correlation between the channels to be reset and the reference channel. This correlation defines an offset value on the working window chosen for the correlation. This working window is advantageously chosen so as to be equal to the working window used for generating the filter. The value of the offset can then be associated with the filter generated in order to be transmitted in addition to the filters so as to make it possible to reconstitute the original inter-channel phase difference when the audio stream is reproduced.

A step of equalising the gains of the signals of the various channels can occur in order to even out the powers of the signals corresponding to the different channels. This equalisation defines an amplification value that is to be applied to the signal on the working window. This amplification value can be introduced into the calculated filter making it possible to reconstitute the signal on decoding. This amplification value is calculated for each channel except one chosen as the reference channel. Introducing the amplification value makes it possible to reconstitute on decoding the differences in gains between the channels in the original signal.

In addition, the calculation for the generation of a filter and for the phase shifting is carried out on a signal portion called the working window (or frame). When the audio stream is restored, the passage from one frame to another will therefore cause a change in phase difference between the channels. This change may cause noise on restoration. To prevent this noise, it is possible to smooth the phase difference at the frame boundaries. Thus the change in frame no longer causes any abrupt change in phase difference.

Figure 6:
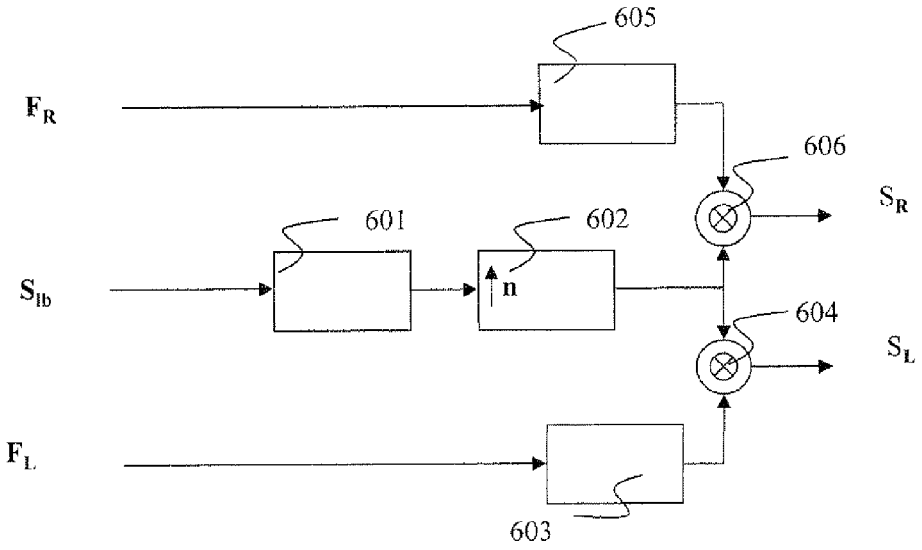
FIG. 6 shows the architecture of a stereophonic embodiment of the decoder.

FIG. 6 shows the architecture of a stereophonic embodiment of the decoder. This figure is the stereophonic counterpart of FIG. 4. The audio stream received is demultiplexed in order to obtain the encoded low-frequency composite stream called $S_{1b}$ and the filters $F_R$ and $F_L$. The composite stream is ten decoded by the decoding module 601 corresponding to the module 404 in FIG. 4. Its spectrum is then broadened in frequency by the supersampling module 602 corresponding to the module 405 in FIG. 4. The signal thus obtained is then convoluted by the filters $F_R$ and $F_L$ decompressed by the modules 603 and 605 in order once again to give the right and left channels $S_R$ and $S_L$.

If phase-difference information is introduced into the stream, the channel that does not serve as a reference channel for the phase difference is reset using this information in order to generate the phase difference of the original channels. This phase-difference information may for example take the form of an offset value associated with each of the filters for the channels other than the channel defined as the reference channel. Advantageously, this phase difference is smoothed, for example linearly, between the various frames.

The invention claimed is:

1. A method of encoding all or part of a multi-channel audio stream, comprising:

obtaining a composite signal produced by composition of signals corresponding to each channel of the multi-channel audio stream;

producing a frequency-limited composite signal from the obtained composite signal by suppression of high frequencies;

producing a locally reconstructed frequency-enhanced composite signal from the frequency-limited composite signal, as might be produced by a remote multi-channel audio stream receiver/decoder from a frequency-limited composite signal; and generating at least one temporal filter per channel that is capable of producing a signal spectrally close to a corresponding channel when said temporal filter is applied to the locally reconstructed frequency-enhanced composite signal.

2. A method according to claim 1, wherein for a portion of the multi-channel audio stream, for a given channel, a filter corresponding to the channel is obtained based upon coefficients of a Fourier transform applied to the channel, or a portion of the multi-channel audio stream, and the locally reconstructed frequency-enhanced composite signal.

3. A method according to claim 2, wherein temporal filters of different sizes are generated for providing a choice of filters for use, the filter selected based upon a comparison of an original channel signal, and a signal obtained by applying the filter to the reconstructed frequency-enhanced composite signal.

4. A method according to claim 1, wherein a collection of predetermined temporal filters is provided for enabling a choice of temporal filter to use.

5. A method according to claim 1, wherein the frequency-limited composite signal is encoded for transmission thereof, a temporal filter is generated based upon at least one channel signal and a locally reconstructed frequency-enhanced composite signal obtained by decoding and broadening an encoded frequency-limited composite signal.

6. A method according to claim 1, further comprising:

defining one of the channels of a multi-channel audio stream as the reference channel;

performing a temporal correlation of each of the other channels on said reference channel defining an offset value for each channel; and composing signals of each channel using the signal of the reference channel and corresponding temporally correlated signals of each of the other channels.

7. A method according to claim 6, wherein for each channel other than the reference channel, an offset value defined by the temporal correlation of the corresponding channel is associated with the generated temporal filter.

8. A method according to claim 6, further comprising:

equalizing each of other non-reference channels based on the said reference channel defining an amplification value for each channel;

and wherein the composing of the signals of each non-reference channel is performed with the signal of the reference channel and corresponding equalized signals of the non-reference channels.

9. A method according to claim 8, wherein for each channel other than the reference channel, the amplification value defined by temporal correlation of a channel is associated with a generated filter.

10. A method of decoding all or part of a multi-channel audio stream, comprising:

receiving a transmitted encoded frequency-limited composite multi-channel audio signal of two or more channels of a multi-channel audio stream;

receiving temporal filter characteristics information based on a reconstructed frequency-enhanced composite signal produced by a transmitter of said encoded frequency-limited composite multi-channel audio signal, said temporal filter characteristics information relating to each channel of the multi-channel audio stream;

decoding a received encoded multi-channel frequency-limited composite signal;

producing a frequency-enhanced composite signal by broadening of the frequency spectrum of a decoded frequency-limited signal; and producing a reconstructed channel signal by convolution of the frequency-enhanced composite signal with a generated temporal filter having characteristics corresponding to the characteristics information received for a channel of the multi-channel audio stream.

11. A method according to claim 10, wherein a temporal filter reduced in size from the generated temporal filter corresponding to received characteristics information is used in place of the generated temporal filter when producing a reconstructed channel signal.

12. A method according to claim 11, wherein the choice of using a temporal filter of reduced size in place of the temporal filter generated for each channel is made in accordance with existing predetermined capabilities of the decoder.

13. A method according to claim 10, wherein one of the channels of the multi-channel stream is defined as a reference channel, and an offset value is associated with each temporal filter characteristics information received for channels other than the reference channel, the method further comprising:

offsetting a signal corresponding to each channel other than the reference channel for generating a temporal phase difference similar to the temporal phase difference between each channel and the reference channel in the original multi-channel audio stream.

14. A method according to claim 13, further comprising:

smoothing offset values for offsetting the signal at the boundaries between the frames so as to avoid an abrupt change in an offset value for each channel other than the reference channel.

15. A method according to claim 10, wherein one of the channels of the multi-channel stream is defined as a reference channel, and an amplification value is associated with each filter received for the channels other than the reference channel, the method further comprising:

amplifying a signal corresponding to each channel other than the reference channel for making it possible to generate a difference in gain similar to a difference in gain between each channel and the reference channel in a multi-channel audio stream as originally received.

16. Device for encoding a multi-channel audio stream comprising:

composite signal producer which forms a composite signal of signals corresponding to each channel of the multi-channel audio stream;

frequency spectrum limiter which produces a frequency-limited composite signal a providing a reduction in the spectrum of the composite signal by suppression of high frequencies;

frequency-enhancing composite signal generator for locally producing a reconstructed frequency-enhanced composite signal, as might be produced by a remote audio stream receiver/decoder from a received frequency-limited composite signal; and a temporal filter generator which generates coefficients characterizing at least one temporal filter per channel based on the locally produced reconstructed frequency-enhanced composite signal, thus making it possible to produce a signal spectrally close to a corresponding channel when said temporal filter is applied to the locally reconstructed frequency-enhanced composite signal.

17. Device for decoding a multi-channel audio stream, comprising:

receiver for receiving a transmitted encoded frequency-limited composite multi-channel audio signal;

receiver for receiving temporal filter characteristics based on a predetermined reconstructed frequency-enhanced composite signal, said characteristics relating to each channel of the multi-channel audio stream;

signal decoder for decoding a received encoded frequency-limited multi-channel audio signal;

signal frequency spectrum enhancer for broadening of the frequency spectrum of a decoded frequency-limited signal; and signal convolutor for producing reconstructed channel signals by convolution of the frequency-enhanced composite signal with received temporal filter characteristics for each channel of the multi-channel audio stream.

18. A method according to claim 1, wherein characteristics of a generated temporal filter are based upon a comparison of one or more channel signals of the multi-channel audio stream to an application of a calculated temporal filter to the local reconstructed frequency-enhanced composite signal.

* * * * *